United States Patent [19]

Meredith

[11] Patent Number: 5,013,460

[45] Date of Patent: May 7, 1991

[54] CENTRIFUGAL WASHER FOR PAPER PULP WITH MEANS TO FEED PULP AS A THIN SHEET

[75] Inventor: Michael D. Meredith, Tigard, Oreg.

[73] Assignee: Kamyr, Inc., Glens Falls, N.Y.

[21] Appl. No.: 435,035

[22] Filed: Nov. 13, 1989

[51] Int. Cl.[5] ..... B01D 33/06; B01D 33/62

[52] U.S. Cl. ..... 210/770; 162/60; 162/316; 162/336; 210/374; 210/377; 210/391; 210/781; 494/36

[58] Field of Search ..... 8/156; 162/60, 202, 162/258, 358, 380, 259, 336, 306, 315, 316; 210/104, 360.1, 369, 374, 377, 380.1, 403, 781, 784, 416.1, 145-148, 770, 391; 494/36, 37

[56] References Cited

U.S. PATENT DOCUMENTS

| | | | |
|---|---|---|---|
| 1,531,482 | 3/1925 | Haug | 210/403 |
| 3,114,309 | 12/1963 | Haug | 100/37 |
| 3,289,843 | 12/1966 | Nyrop | 210/374 |
| 3,642,139 | 2/1972 | Wilson et al. | 210/374 |
| 3,948,677 | 4/1976 | Huster et al. | 127/66 |
| 4,186,097 | 1/1980 | Dudley et al. | 210/380.1 |
| 4,698,919 | 10/1987 | Wedel | 162/202 |
| 4,827,741 | 5/1989 | Luthi | 162/60 |

FOREIGN PATENT DOCUMENTS

| | | | |
|---|---|---|---|
| 897299 | 1/1982 | U.S.S.R. | 494/36 |
| 1294980 | 11/1972 | United Kingdom | 210/377 |

OTHER PUBLICATIONS

Kamyr M-57 Washer brochure, Ref. 181E, Kamyr AB of Karlstad, Sweden.

Handbook for Pulp & Paper Technologists, G. A. Smook, 1986, pp. 108 through 111.

Berry et al., "Optimization of 'Fiberfuge' Washer Process Results,"; 1982 Pulping Conference, TAPPI Proceedings, pp. 457-459.

*Primary Examiner*—Robert A. Dawson
*Assistant Examiner*—Joseph Drodge
*Attorney, Agent, or Firm*—Nixon & Vanderhye

[57] ABSTRACT

A method and apparatus provide for the effective centrifugal washing and/or thickening of paper pulp, using a perforated cylinder. A stock head box, located within the cylinder, applies a thin sheet of pulp on the interior the cylinder, at a high rate (e.g. about 20 meters per second), at a first arcuate position. The cylinder is rotated at high speed (e.g. 100 rpm, to provide an acceleration on the order of about 10 gs), whereby centrifugal force causes liquid in the pulp to move radially outwardly through the openings in the screen cylinder. The pulp is withdrawn from the interior of the cylinder by a vacuum roll or the like at a second arcuate position less than 360° from the first position. The withdrawn pulp is moved by a screw conveyor or the like away from the cylinder in a dimension generally parallel to the axis of rotation, and the withdrawn liquid passes through channels in a drum surrounding the perforated cylinder, and is engaged by an impeller, and flows to a volute for removal. Wash water may be added by a wash water head box within the cylinder between the first and second arcuate positions. A drive roll operatively engages the exterior of the cylinder for effecting rotation.

20 Claims, 2 Drawing Sheets

CENTRIFUGAL WASHER FOR PAPER PULP WITH MEANS TO FEED PULP AS A THIN SHEET

BACKGROUND AND SUMMARY OF THE INVENTION

Washers and thickeners are relatively expensive components of conventional pulp mills. Conventional thickeners and washers usually comprise a cylindrical drum to which a vacuum is applied over the forming and washing zones. The rate of application of the pulp as a sheet to the rotating vacuum drum exterior surface is typically slow, on the order of about 1 meter per second for conventional pressure washers. The drum also rotates relatively slowly, on the order of about 4 rpm. Therefore, the amount of pulp treated per screen area is relatively small. Since the cost of conventional thickeners/washers is strongly dependent upon their size, such devices typically end up being expensive components of the mills.

It has been recognized that the thinner the layer of pulp through which the water must travel, the faster the thickening and washing operations can be accomplished, and the smaller the thickening/washing machine may be. However the art has not been able to make practical use of this known physical phenomena.

One way that use of the thin sheet advantages can be achieved is by utilizing centrifugal force to cause the filtrate to move through the pulp. In U.S. Pat. No. 3,289,843, an apparatus is described having several different embodiments for centrifugal washing/filtering. However such centrifuges have not proven particularly effective in the pulp and paper field.

According to the present invention, a method and apparatus are provided that take advantage of centrifugal force to cause thin sheets of pulp to be formed on a screen, and also provide the motive force for moving the filtrate through the pulp. Utilizing the invention, it is possible that washers having about a 10 times smaller screen area compared to conventional vacuum drum washers are possible, thickening and washing can be obtained without any rubbing seals to confine a vacuum or the like, there is no necessity for external devices such as droplegs, vacuum pumps, or fans, to provide the motive force for water to move through the pulp.

According to one aspect of the present invention, an advantageous pulp thickener/washer is provided which comprises the following elements: (a) A perforated cylinder having an interior and an exterior. (b) Means for applying pulp in a thin sheet on the interior of the cylinder at a first arcuate position thereof. (c) Means for rotating the cylinder about an axis of rotation so that liquid in the sheet is caused to move radially outwardly through the cylinder as a result of centrifugal force, so that the pulp is thickened. (d) Means for withdrawing the pulp from the interior of the cylinder at a second arcuate position, less than 360° from the first position. (e) Means for moving the withdrawn liquid and treated pulp away from the thickener/washer for subsequent treatment, use, or disposal. And, (f) means for applying wash water to the pulp at the interior of the cylinder at a third arcuate position between the first and second positions.

The means (b) preferably comprises a stock head box similar to that utilized to form sheets of paper or pulp. The velocity of pulp from the head box, which is provided by line pressure, is preferably at least about 10 meters per second, and typically at least about 20 meters per second, to approximately match the speed of the rotating cylinder. The means (f) also comprises a wash water head box. The means (d) preferably comprises a vacuum roll, although an air doctor or steam doctor alternatively may be utilized. The means (e) can be selected from a wide variety of chutes, conveyors, or the like, but preferably comprises a screw conveyor extending in a dimension generally parallel to the axis of rotation of the screen cylinder. The means (e) for filtrate removal preferably comprises means defining channels in a drum surrounding the screen, an impeller, and a volute, with a cut-off shoe for the impeller at an arcuate section generally between the first and second arcuate positions, to facilitate pulp removal at that point. The means (c) preferably comprises a drive roller which operatively engages the exterior of the cylinder to rotate it about a generally horizontal axis, and the cylinder may be a cylindrical perforated plate, or a cylindrical wire cloth.

According to another aspect of the present invention, a method of acting on paper pulp to thicken and/or wash it utilizing centrifugal force is provided. The effective method according to the invention comprises the steps of substantially sequentially: (a) Applying pulp in a thin sheet on an interior of the cylinder at a first arcuate position. (b) Rotating the cylinder about its axis to cause liquid in the pulp to move radially outwardly, under the influence of centrifugal force, through the cylinder, to be discharged. (c) Withdrawing the sheet from the cylinder at a second arcuate position less than 360° from the first position. (d) Passing the pulp to a further treatment or use stage. And, (e) adding wash water to the interior of the sheet between the first and second arcuate positions. Step (a) is practiced at a rate of at least about 10 meters per second (e.g. about 20 meters per second), and step (b) is practiced at a rate of at least about 25 rpm (e.g. about 100 rpm). Paper pulps entering at a wide variety of consistencies may be treated, and will typically have a consistency of about 8–12% during and/or after treatment.

It is the primary object of the present invention to provide for the effective washing and/or thickening of paper pulp or like suspensions, utilizing centrifugal force as the main motive force for filtrate movement. Practicing the invention it is possible to reduce the screen area/daily ton of pulp processed, thereby significantly decreasing washer costs, while at the same time providing effective treatment. These and other objects of the invention will become clear from an inspection of the detailed description of the invention and from the appended claims.

DETAILED DESCRIPTION OF THE DRAWINGS

Figure 1:
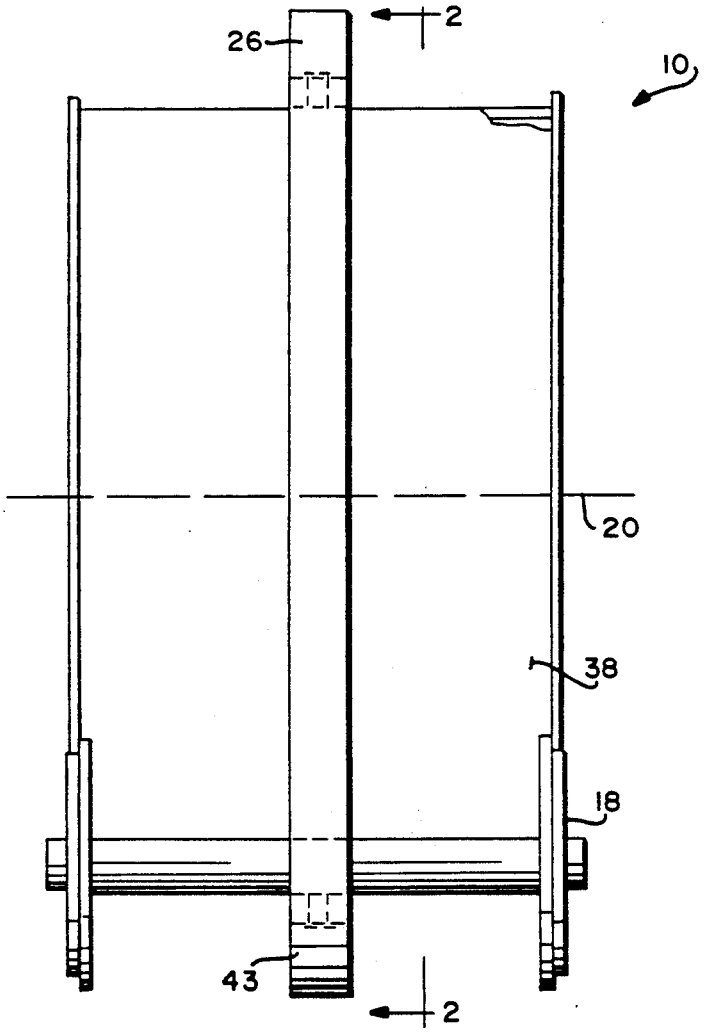
FIG. 1 is a side schematic view of an exemplary pulp thickener/washer according to the invention.
Figure 3:
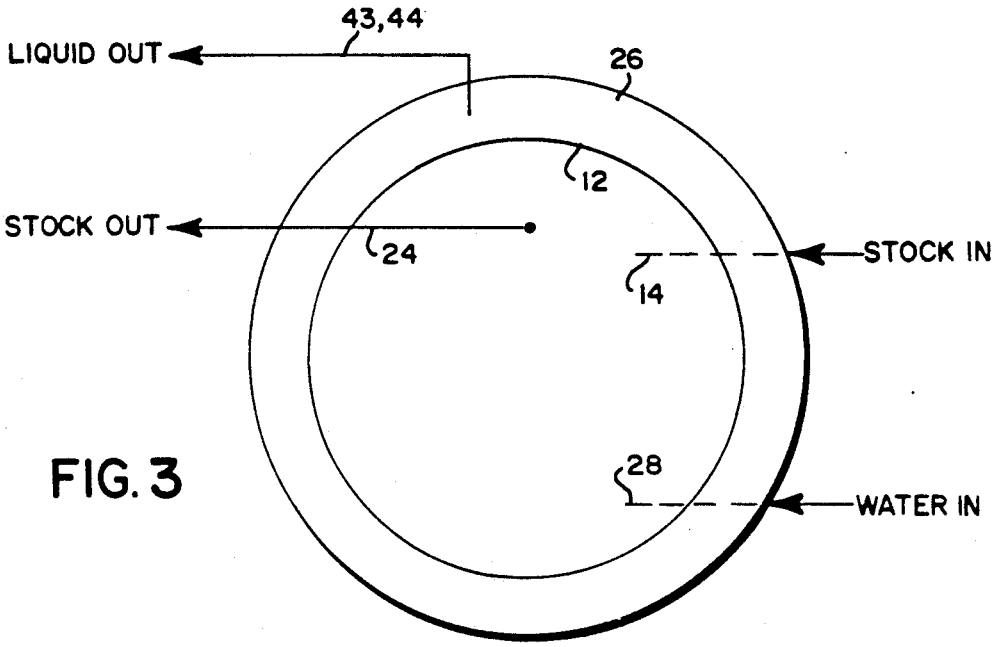
FIG. 3 is a diagrammatic illustration of the pulp in liquid movements in the device of FIGS. 1 and 2.
Figure 2:
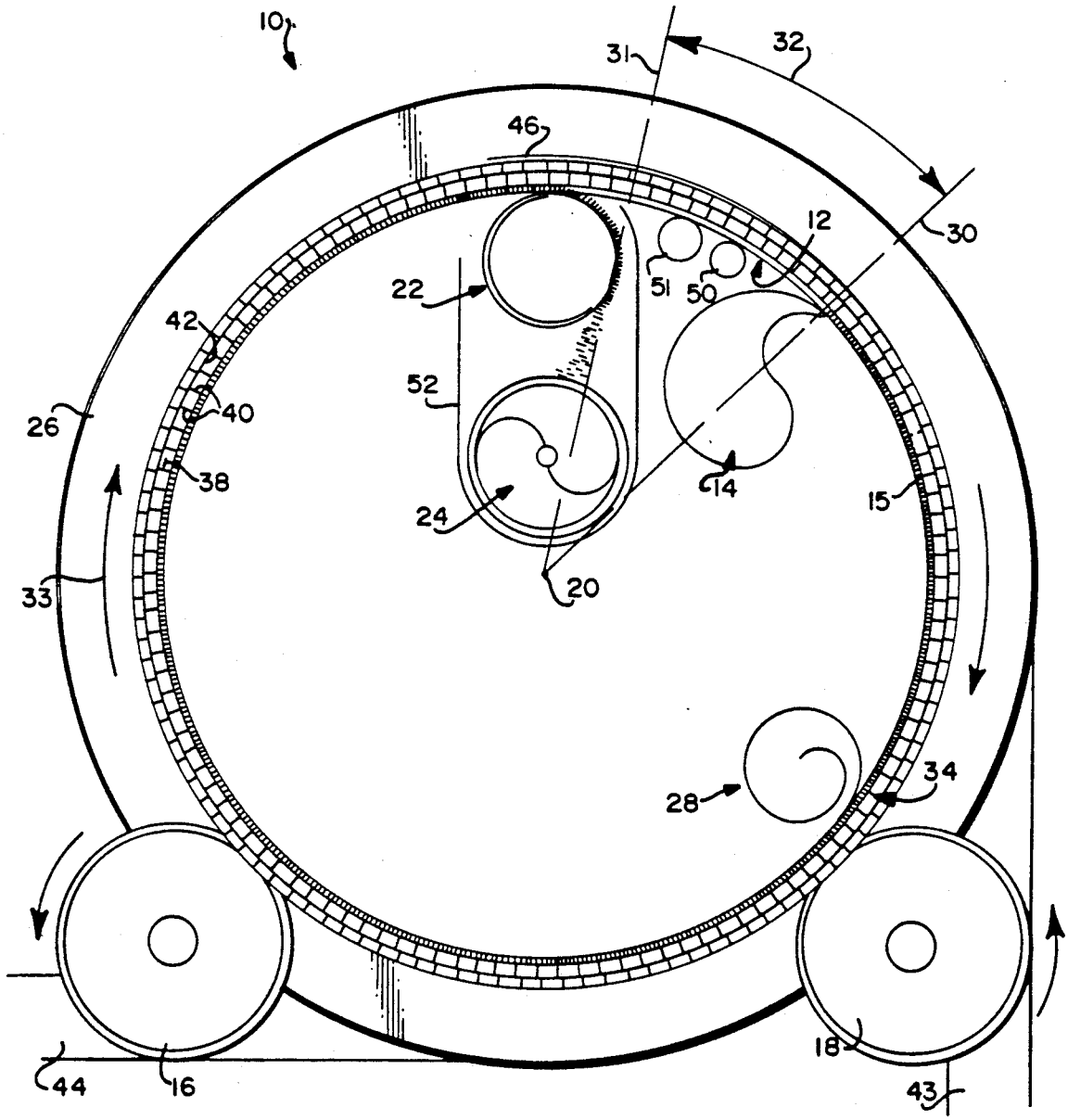
FIG. 2 is an end view, partly in cross-section and partly in elevation, taken along lines 2—2 of FIG. 1, of the device of FIG. 1.

An exemplary washer/thickener according to the present invention is shown generally by reference numeral 10 in FIGS. 1 and 2. Major components of the device 10 comprise: a perforated cylinder 12 having an interior surface and an exterior surface; means—such as stock head box 14—for applying pulp 15 in a thin sheet on the interior of the cylinder 12; means, such as the drive roll 16 and idler 18, for rotating the cylinder about an axis 20; means, such as vacuum roll 22, for withdrawing the pulp from the interior of the cylinder; and means, such as the screw conveyor 24 for the pulp, and the stationary volute 24 and associated components for the filtrate, for withdrawing the liquid and treated pulp away from the thickener and washer 10 for subsequent treatment, use, or disposal. Also, there preferably is provided a means—such as wash water head box 28—for applying wash water to the pulp.

The stock is applied to the interior of the cylinder 12 by the stock head box 14 or the like at a first arcuate position 30. The head box 14 is similar to that utilized to form sheets of paper pulp. The high velocity is provided by the line pressure to the head box 14, and the velocity typically is at least about 10 meters per second, e.g. about 20 meters per second. The velocity of the pulp is adjusted to approximately match the speed of the rotating cylinder 12. This compares with a velocity of one meter per second in conventional pressure washers.

The vacuum roll 22, or like pulp withdrawal means such as an air doctor or steam doctor, withdraws the pulp from the interior surface of the cylinder 12 at a second arcuate position 31, which is less than 360° from the first position 30. That is, there is a positive arcuate angle 32 between the positions 30, 31. In the exemplary embodiment illustrated in FIG. 2, the angle 32 is about 40°, meaning that the arcuate spacing of the pulp application position 30 and the pulp withdrawal position 31 in the direction of rotation 33 is about 320°. Wash water is applied by the wash water head box 28. Head box 28 is located in an arcuate position 34 between the first and second positions 30, 31, and preferably closer to the head box 14 than the vacuum roll 22. It should be positioned where the sheet 15 has had sufficient liquid centrifugally withdrawn to have good integrity, but before air begins to be drawn into the sheet. For example in the exemplary embodiment illustrated in FIG. 2, the arcuate spacing between the head boxes 14, 28 is on the order of 80°.

The cylinder 12 has perforations therein through which filtrate flows, while the pulp remains in contact therewith. The cylinder 12 may be made in a wide variety of conventional forms. For instance it may be provided as a perforated plate, or it may be a wire cloth, both of which are presently commonly used in vacuum washers. Wire cloth may be particularly advantageous because it lets less fibers through, however it may pose a problem because the pulp is applied to the interior of the cylinder. Therefore when a wire cloth is utilized as the cylinder 12, it may be desirable to use expandable hoops to hold the wire taut against the interior of drum 38 with a turn buckle at the splits of each hoop to expand the hoops tightly into place.

The means for removing the filtrate which passes radially outwardly through the thin sheet of pulp 15 preferably includes a drum 38, and accessory components. The drum 38 is exterior of the cylinder 12, and provides support for it so that the cylinder itself may be very thin. The drum 38 has means defining radial, axial, and/or circumferential channels 40 therein, which lead filtrate from both ends of the drum toward openings along the equator of the drum 38. To magnify the differential pressure further, the filtrate passes through a closed impeller 42 of a centrifugal pump at the volute 26. The filtrate is then collected in the volute 26, which surrounds the impeller section. The volute 26 does not need to rub the impeller to prevent water from leaking out at that point since centrifugal force holds the water on the outside of the volute. Any splash which might be aimed at the opening would likewise be thrown back into the volute by the rotation of the impeller. Filtrate is discharged from the volute at one or more points 43, 44, to external piping, so that the filtrate is removed for subsequent treatment, use, or disposal.

In order to help release the pulp sheet 15 for discharge at the second arcuate position 31, preferably a shoe 46 is provided extending an arcuate distance slightly greater than the angle 32, between the first and second positions 30, 31. The shoe covers the impeller at that area, which cuts off the differential pressure and facilitates release of the sheet 15 to the perforated surface of the vacuum roll 22. Also a back flow of air or water may be applied through the shoe 46 to compensate for leakage around it, if necessary.

The drive roll 16 is driven by a conventional motor to achieve a high rate of drum speed, e.g. preferably at least about 25 rpm, for example about 100 rpm, so that the centrifugal force will be high, the sheet 15 will be thin, and the filtrate will move quickly through the sheet for complete treatment in the relatively small arcuate extent of about 320° between the first and second positions 30, 31. The drive roll 16 operatively engages the exterior of the cylinder 12 through the drum 38.

Other accessory components may also be utilized. For example a conventional wire cleaner 50 may be provided on the interior of the cylinder 12 acting on the inside surface of the cylinder 12 within the angular position 32, and a warning roll 51 may also be provided in that arcuate area. Also, a pulp containing trough 52 may be provided around the screw conveyor 24, the screw conveyor 24 being rotatable about an axis that is generally parallel to the axis 20 of rotation of the screen cylinder 12, which axis 20 preferably is horizontal. Instead of the screw conveyor 24, however, other types of conveyors, an inclined chute, or a sluice may be utilized.

The method according to the invention comprises a method of acting on paper pulp, or like suspensions, which may have a wide variety of consistencies, for example on the order of about ¼–14% (the range over which head boxes have been known to operate or are expected to operate in the future). The method comprises the steps of substantially sequentially: Applying pulp in a thin sheet 15 on the interior of the cylinder 12 at the first arcuate position 30. Rotating the cylinder 12 about axis 20, at high speed (e.g. to achieve a drum speed of at least about 25 rpm, for example 100 rpm) —so as to achieve acceleration on the order of about 10 gs.—to cause the liquid in the pulp to move radially outwardly through the cylinder 12 under the influence of centrifugal force to be discharged. (This high rotational speed, and acceleration, inherently assists in ensuring that the sheet 15 is thin.) Withdrawing the sheet of pulp 15 from the cylinder 12 at the second arcuate position 31 less than 360° (e.g. on the order of about 320°) from the first position 30, utilizing the vacuum roll 22, cut-off shoe 46, and the like. Passing the pulp, utilizing screw conveyor 24 and trough 52, or the like, to a further treatment or use stage; and preferably adding wash water to the interior of the sheet at the arcuate position 34, utilizing wash water head box 28 or the like.

The wash water addition arcuate position 34 is disposed at a point where the sheet 15 has reached a consistency firm enough to avoid being disrupted, but before much air becomes entrained therein.

In the practice of the method according to the invention, air that is entrained either in the filtrate or the pulp will also tend to be centrifuged out of the system. Further, the filtrate is discharged at such a velocity that it has a considerable head, and it can be transported in the conduits 43, 44 to wherever it is needed without further pumping or further tankage. The pulp sheet 15 may be applied at a high rate by the head box 14, e.g. at at least about 10 meters per second (for example 20 meters per second), compared to about one meter per second in the prior art. The speed is adjusted to approximately match that of the rotary cylinder. Thus effective treatment of pulp utilizing equipment having a minimal screen area per ton of pulp processed, is provided.

According to the invention a method and apparatus have been described which have a number of advantages over-the conventional systems. Because a very thin sheet 15 of pulp is provided due to the centrifugal force that exists because of the high rate of speed of the cylinder, washers having about 10 times a smaller screen area than is conventional may be provided. Differential pressure is enhanced because the filtrate has a finite depth as it is drained from the pulp at the point (the volute 26 of the equator of the drum 38) where the liquid discharges from the drum. No rubbing seals are necessary to confine the vacuum or the pressure differential, and pressure differential is not produced by any external device such as a dropleg, vacuum pump, or fan. No additional devices are necessary to pump the removed filtrate to additional use or storage areas, and air inherently is removed from the system. While the advantageous method and apparatus according to the invention have been shown in what is presently conceived to be the most practical and preferred embodiment thereof, it will be apparent to those of ordinary still in the art that many modifications may be made thereof within the scope of the invention, which scope is to be accorded the broadest interpretation of the appended claims so as to encompass all equivalent structures and methods.

What is claimed is:

1. A pulp thickener/washer comprising:

(a) a perforated cylinder having an interior surface and an exterior surface;

(b) means comprising a stock head box terminating at the interior surface of the cylinder for applying pulp in a thin sheet on the interior surface of said cylinder at a first arcuate position thereof;

(c) means for rotating said cylinder about an axis of rotation so that liquid in the sheet is caused to move radially outwardly through the cylinder as a result of centrifugal force, so that the pulp is thickened;

(d) means for withdrawing the pulp from the interior of the cylinder at a second arcuate position, less than 360° from said first position; and (e) means for moving the withdrawn liquid and treated pulp away from the thickener/washer for subsequent treatment, use, or disposal.

2. A device as recited in claim 1 further comprising (f) means for applying wash water to the pulp at the interior of the cylinder at a third arcuate position between said first and second positions.

3. A device as recited in claim 2 wherein said means (b) comprises a stock head box, and said means (f) comprises a wash water head box.

4. A device as recited in claim 3 wherein said means (d) comprises a vacuum roll.

5. A device as recited in claim 4 wherein said means (e) comprises, for the pulp, a screw conveyor rotatable about an axis generally parallel to the axis of rotation of said cylinder, in a trough.

6. A device as recited in claim 1 wherein said cylinder comprises a cylindrical perforated plate.

7. A device as recited in claim 1 wherein said cylinder comprises a cylindrical wire cloth.

8. A method of acting on pulp to treat it utilizing centrifugal force, and utilizing a perforated cylinder having an interior surface and an exterior surface and rotatable about axis, said method comprising the steps of substantially sequentially:

(a) applying pulp from a stock head box in a thin sheet directly onto an interior surface of the cylinder at a first arcuate position;

(b) rotating the cylinder about its axis to cause liquid in the pulp to move radially outwardly, under the influence of centrifugal force, through the cylinder, to be discharged;

(c) withdrawing the sheet from the cylinder at a second arcuate position less than 360° from the first position in the direction of rotation; and (d) passing the pulp to a further treatment or use stage.

9. A method as recited in claim 8 wherein step (a) is practiced at a rate approximating the rotational speed of the rotating cylinder.

10. A method as recited in claim 9 wherein step (a) is practiced at a rate of about 20 meters per second.

11. A method as recited in claim 9 wherein step (a) is practiced to provide a drum speed of at least about 25 rpm.

12. A method as recited in claim 11 wherein step (b) is practiced to achieve an acceleration of about 10 gs.

13. A method as recited in claim 11 comprising the further step (e) of adding wash water to the interior of the sheet between the first and second arcuate positions.

14. A method as recited in claim 8 wherein step (c) is practiced by applying a vacuum to the interior of the sheet at the second arcuate position.

15. A method as recited in claim 8 comprising the further step (e) of adding wash water to the interior of the sheet between the first and second arcuate positions.

16. A pulp thickener/washer comprising:

(a) a perforated cylinder having an interior surface and an exterior;

(b) means comprising a stock head box for applying pulp directly onto the interior surface of said cylinder at a first arcuate position thereof;

(c) means for rotating said cylinder about an axis of rotation so that liquid in the pulp is caused to move radially outwardly through the cylinder as a result of centrifugal force, so that the pulp is thickened;

(d) a vacuum roll for withdrawing the pulp from the interior of the cylinder at a second arcuate position, less than 360° from said first position; and (e) means for moving the withdrawn liquid and treated pulp away from the thickener/washer for subsequent treatment, use, or disposal.

17. A pulp thickener/washer comprising:

(a) a perforated cylinder having an interior surface and an exterior;

(b) means for applying paper pulp in a thin sheet directly onto the interior surface of said cylinder at a first arcuate position thereof;

(c) means for rotating said cylinder about an axis of rotation so that liquid in the pulp is caused to move radially outwardly through the cylinder as a result of centrifugal force, so that the pulp is thickened;

(d) means for withdrawing the pulp from the interior of the cylinder at a second arcuate position, less than 360° from said first position; and (e) means for moving the withdrawn liquid and treated pulp away from the thickener/washer for subsequent treatment, use, or disposal, comprising a drum surrounding said cylinder, means defining channels in said drum extending to an impeller, and a volute surrounding said impeller.

18. A device as recited in claim 17 wherein said means (d) further comprises a cut-off shoe extending over an arcuate section of said impeller an arcuate length generally corresponding to the shortest arcuate section between said first and second positions.

19. A pulp thickener/washer comprising:

(a) a perforated cylinder having an interior surface and an exterior surface;

(b) means comprising a stock head box for applying pulp the interior surface of said cylinder at a first arcuate position thereof;

(c) means for rotating said cylinder about an axis of rotation so that liquid in the pulp is caused to move radially outwardly through the cylinder as a result of centrifugal force, so that the pulp is thickened, said means comprising a drive roll operatively engaging the exterior surface of said cylinder to rotate it about a generally horizontal axis;

(d) means for withdrawing the pulp from the interior surface of the cylinder at a second arcuate position, less than 360° from said first position; and (e) means for moving the withdrawn liquid and treated pulp away from the thickener/washer for subsequent treatment, use, or disposal.

20. Pulp treating apparatus comprising:

a perforated cylinder having an interior surface and an exterior surface;

a stock head box located within the cylinder directly adjacent the cylinder interior surface;

a wash water head box located within said cylinder adjacent the cylinder interior surface, at an arcuate position spaced from said stock head box;

means disposed exteriorly of the cylinder and operatively engaging the cylinder for effecting rotation thereof about an axis in a direction of rotation;

a vacuum roll located within said cylinder adjacent the cylinder interior surface at an arcuate position between said stock head box and wash water head box and downstream of said wash water head box in said direction of rotation;

pulp conveying means adjacent said vacuum roll and operatively associated therewith; and a volute surrounding said perforated cylinder at a portion thereof.

* * * * *